US006896342B1

(12) United States Patent
Cheng

(10) Patent No.: US 6,896,342 B1
(45) Date of Patent: May 24, 2005

(54) CABINET ANTI-TILT SAFETY APPARATUS

(75) Inventor: Chen Kung Cheng, Taichung Hsien (TW)

(73) Assignee: E-Make Co., Ltd., Taichung Hsien (TW)

( * ) Notice: Subject to any disclaimer, the term of this patent is extended or adjusted under 35 U.S.C. 154(b) by 0 days.

(21) Appl. No.: 10/885,626

(22) Filed: Jul. 8, 2004

(51) Int. Cl.[7] ..... E05B 65/46

(52) U.S. Cl. ..... 312/221; 312/217

(58) Field of Search ..... 312/215, 216, 312/217, 220, 221, 222, 107.5; 70/78, 85; 292/DIG. 18

(56) References Cited

U.S. PATENT DOCUMENTS

| | | | | |
|---|---|---|---|---|
| 1,613,731 | A * | 1/1927 | Stockov | 312/221 |
| 5,782,545 | A * | 7/1998 | Kahara et al. | 312/217 |
| 6,347,848 | B1 * | 2/2002 | Cho | 312/219 |
| 6,637,843 | B2 * | 10/2003 | Westwinkel | 312/221 |
| 6,742,854 | B2 | 6/2004 | Chen | 312/217 |
| 6,749,274 | B2 * | 6/2004 | Westwinkel | 312/221 |

FOREIGN PATENT DOCUMENTS

| | | | |
|---|---|---|---|
| DE | 2658076 | * | 7/1978 |
| FR | 536093 | * | 2/1922 |

* cited by examiner

*Primary Examiner*—James O. Hansen
(74) *Attorney, Agent, or Firm*—Troxell Law Office, PLLC

(57) ABSTRACT

A cabinet anti-tilt safety apparatus including a cabinet body, at least two drawers arranged in the cabinet body, an activation section disposed on rear side of each drawer, a base seat fixed on inner face of a panel of the cabinet body corresponding to the rear side of each drawer, a slide seat slidably fitted with the base seat and movable between a first position and a second position, a first connecting section disposed at one end of the base seat and a second connecting section disposed at one end of the slide seat corresponding to the first connecting section. A block body is disposed on the slide seat corresponding to the activation section. The activation section can get into or out of the corresponding block body. After one drawer is drawn out, the activation section of the drawn out drawer via the block body drives the slide seat and then the first connecting section are engaged with the second connecting section, whereby the slide seat is positioned in the first position and the activation sections of the remaining drawers are engaged with the corresponding block bodies.

6 Claims, 6 Drawing Sheets

CABINET ANTI-TILT SAFETY APPARATUS

BACKGROUND OF THE INVENTION

The present invention is related to a drawer locking apparatus of a cabinet body, and more particularly to an anti-tilt and internal locking apparatus for a tool cabinet or a file cabinet having several drawers.

A drawer and a cabinet body are equipped with corresponding rails. The rails are slidably fitted with each other for easily pushing or drawing the drawer within the cabinet body. The rails are provided with stoppers such as projecting blocks or projecting plates to prevent the drawer from detaching from the cabinet body and dropping.

The drawer is often designed with a considerable length for receiving more articles. In order to fully draw the drawer out of the cabinet without being derailed and immediately push the drawer into the cabinet after taking articles, three rails are provided, that is, a cabinet body slide rail, a middle slide rail and a drawer slide rail. Each slide rail has stop blocks on predetermined portions of one end or two ends of the slide rail. The slide rails are slidably assembled with each other and the stop blocks stop each other, whereby the drawer can be fully drawn out of the cabinet without derailing and dropping. Ball bearings are provided between the slide rails to reduce frictional force therebetween and noise.

The tool cabinet or file cabinet includes several drawers arranged from upper side to lower side. After the drawers contain tools or files, the drawers will have considerable weight. In the case that the drawers are drawn too hard or in the case of earthquake or collision by external force, the tool cabinet or file cabinet will be tilted to make some drawers slip out. Under such circumstance, the gravity center of the cabinet will change and the cabinet may fall down.

In order to avoid tilting down of the cabinet when drawing out too many drawers, a slide rail locking structure has been developed by which only one drawer can be drawn at one time. Substantially, a linking unit is disposed at one end of each slide rail assembly. Once the drawer slide rail of one slide rail assembly is pulled, the linking unit is activated to drive a link disposed between the respective slide rail assemblies to stop the drawer slide rails of other slider rail assemblies from being pulled. For example, in U.S. Pat. No. 5,352,030, a disc-like activating block is disposed at rear end of the drawer slide rail. In U.S. Pat. No. 5,634,701, an activating block having a slope is disposed at front end of one side of the drawer. In U.S. Pat. No. 5,988,778, an activating block is disposed at front end of the drawer slide rail.

In the above U.S. patents, several controlling elements are disposed on the slide rail assembly. The slide rail assembly has limited space so that it necessitates higher precision to add the controlling elements to the slide rail assembly and adapt the controlling elements to the space between the slide rail assemblies. As a result, the cost is increased.

SUMMARY OF THE INVENTION

It is therefore a primary object of the present invention to provide a cabinet anti-tilt safety apparatus which has simple components and can be easily assembled to achieve the anti-tilt effect for the cabinet body.

It is a further object of the present invention to provide the above cabinet anti-tilt safety apparatus which is arranged in the narrow internal space of the cabinet body to truly achieve the drawer locking function. After one of the drawers is drawn out, the other drawers are prevented from being drawn out.

According to the above objects, the cabinet anti-tilt safety apparatus of the present invention includes a cabinet body, at least two drawers, an activation section disposed on each drawer, a base seat, a slide seat, a block body disposed on the slide seat corresponding to the activation section, a first connecting section and a second connecting section.

The present invention can be best understood through the following description and accompanying drawings wherein:

BRIEF DESCRIPTION OF THE DRAWINGS

FIG. 5 is a sectional view according to FIG. 4, showing that the drawn out drawer is pushed in.

DETAILED DESCRIPTION OF THE PREFERRED EMBODIMENTS

Figure 1:
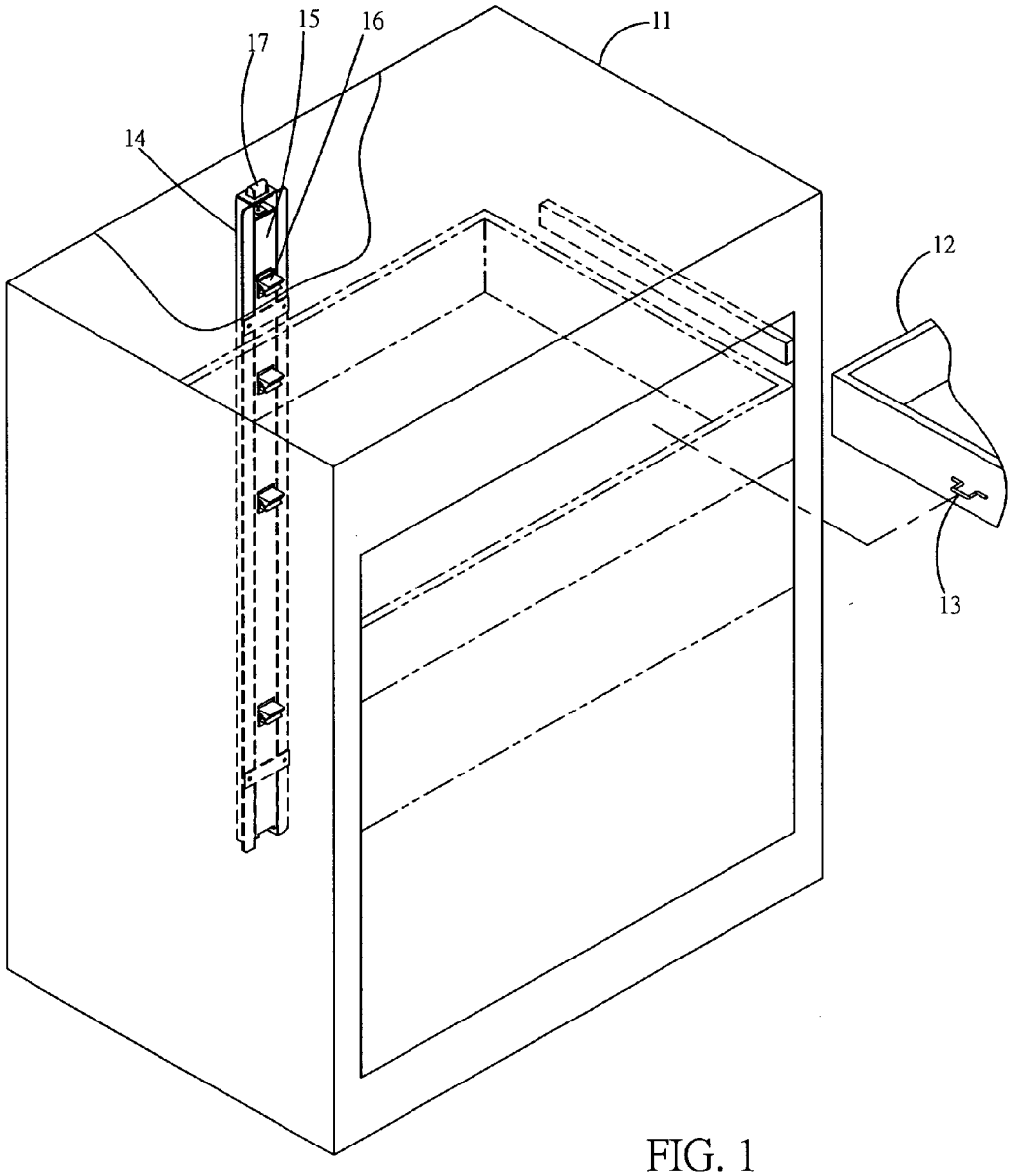
FIG. 1 is a perspective assembled view of a preferred embodiment of the present invention.
Figure 2:
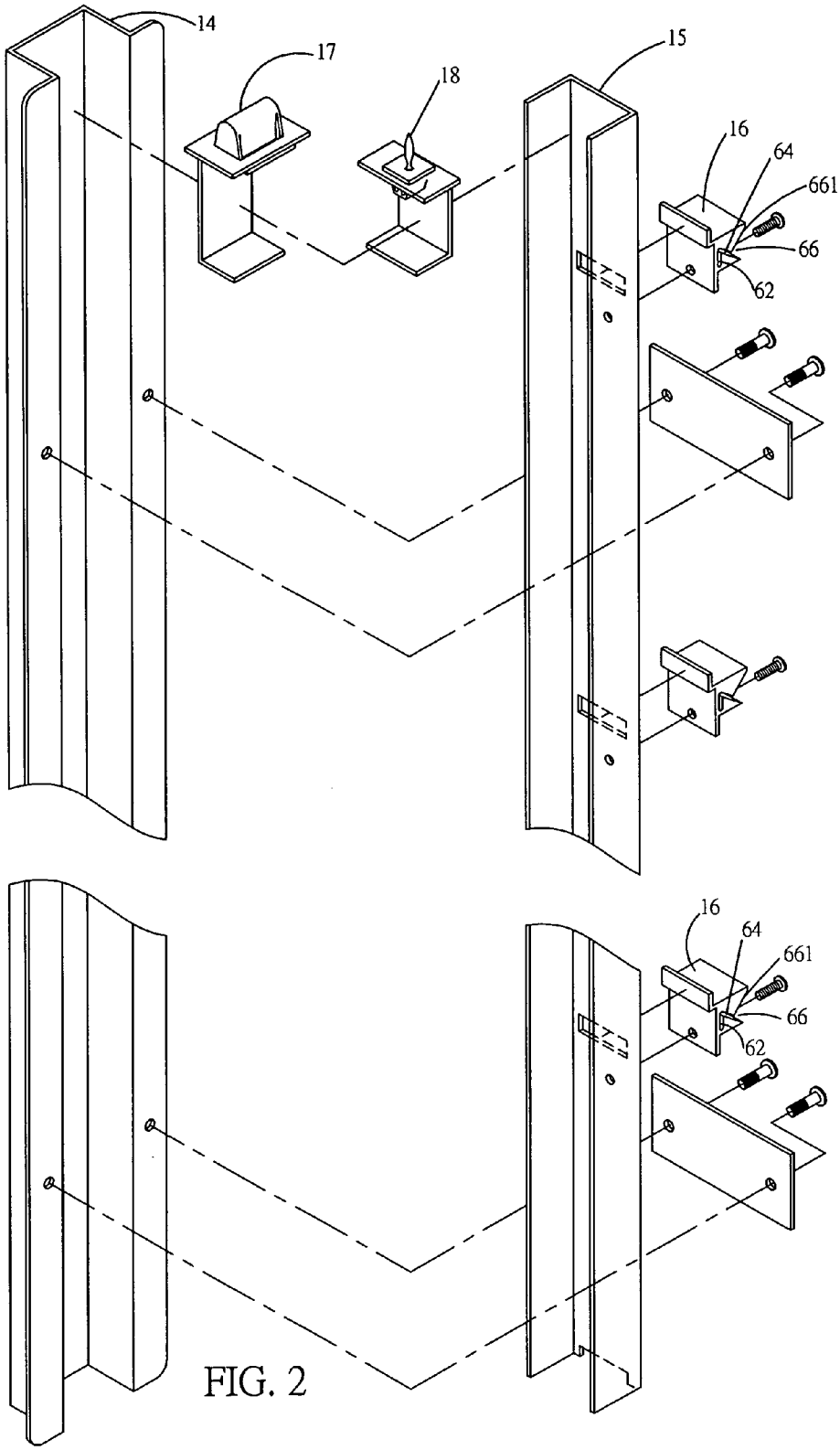
FIG. 2 is a perspective exploded view of the base seat, slide seat, first connecting section and second connecting section of the preferred embodiment of the present invention.
Figure 3:
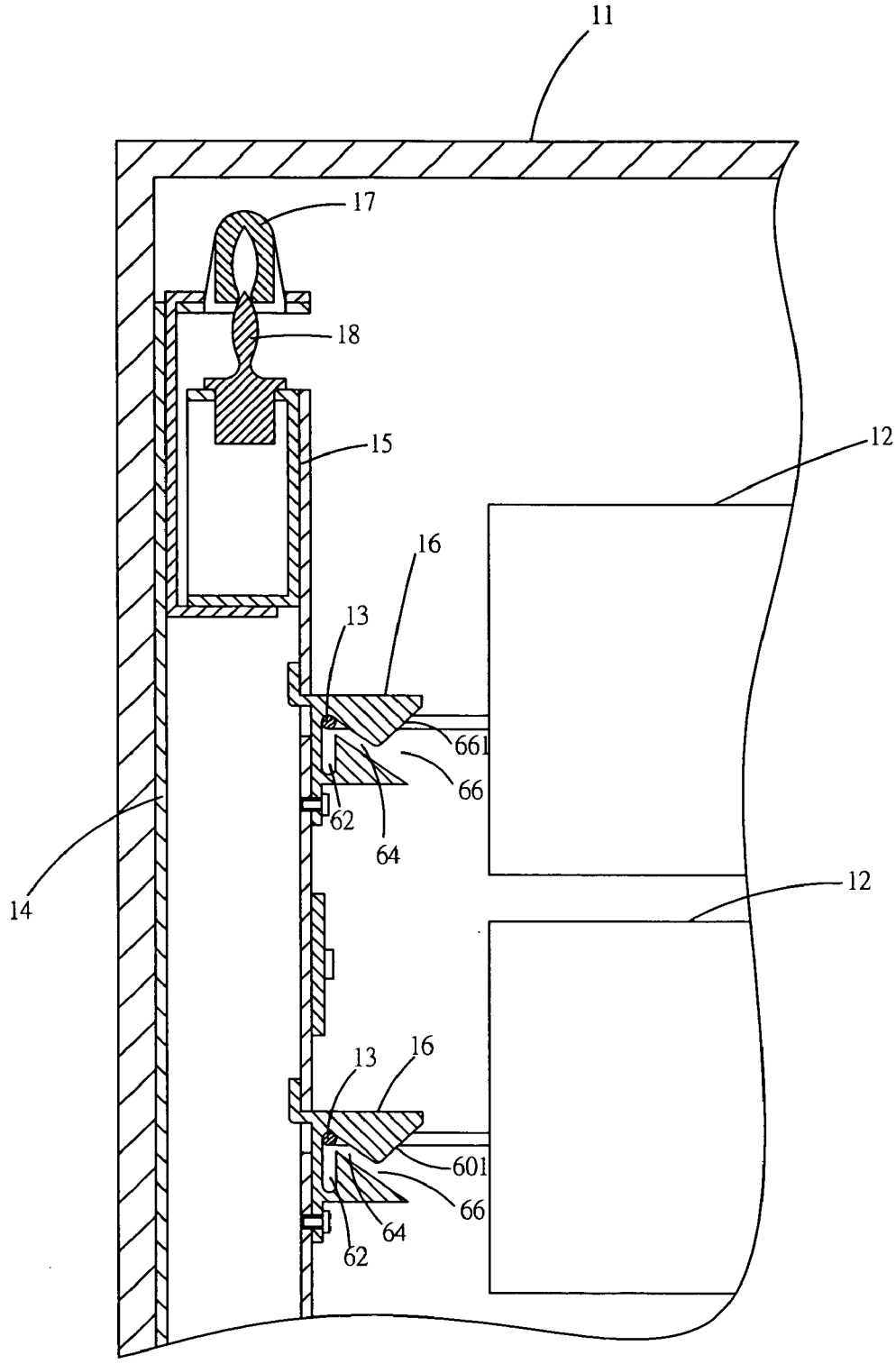
FIG. 3 is a partially sectional view showing that all the drawers of the present invention are not drawn out.
Figure 4:
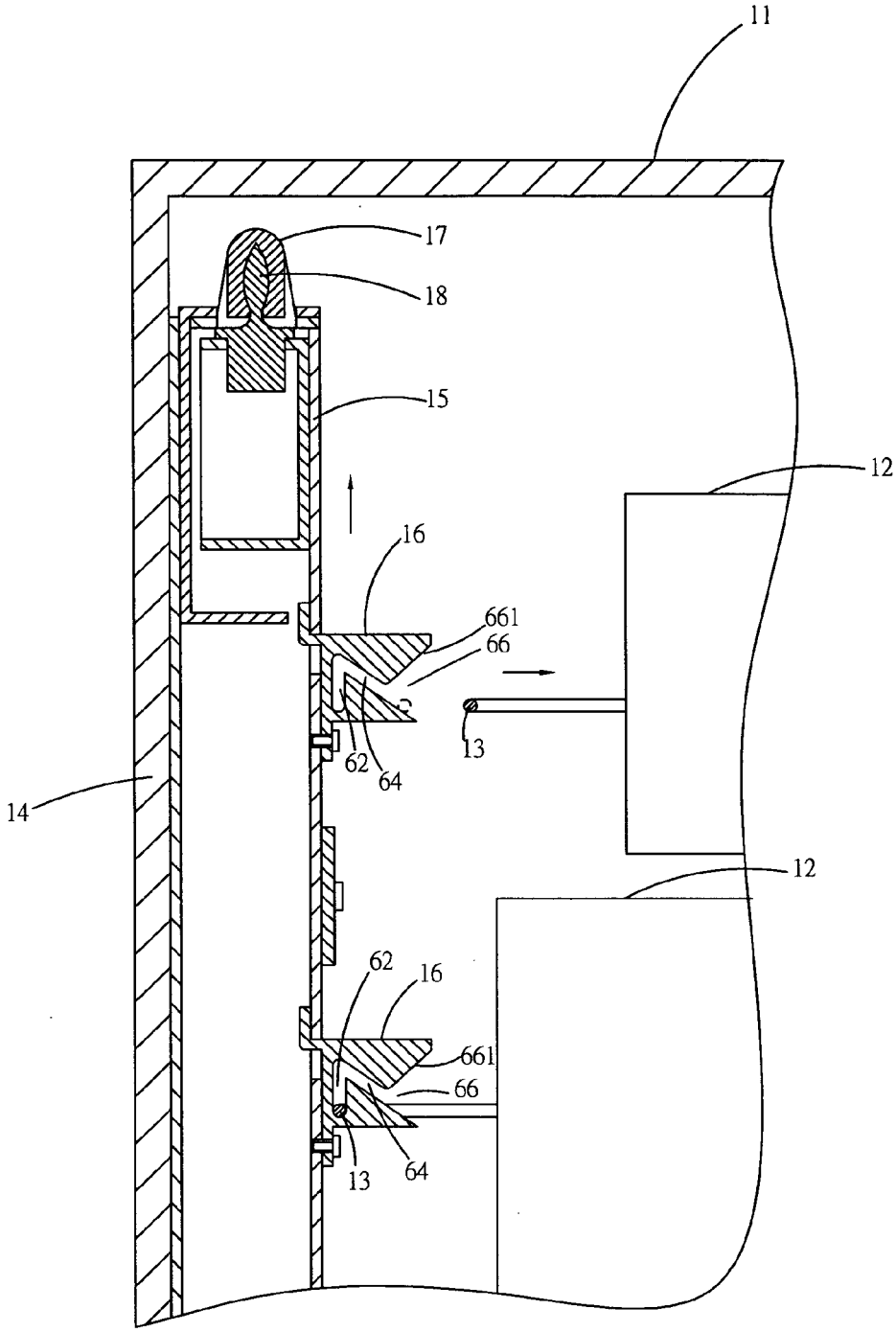
FIG. 4 is a sectional view according to FIG. 3, showing that one of the drawers is drawn out.
Figure 5:
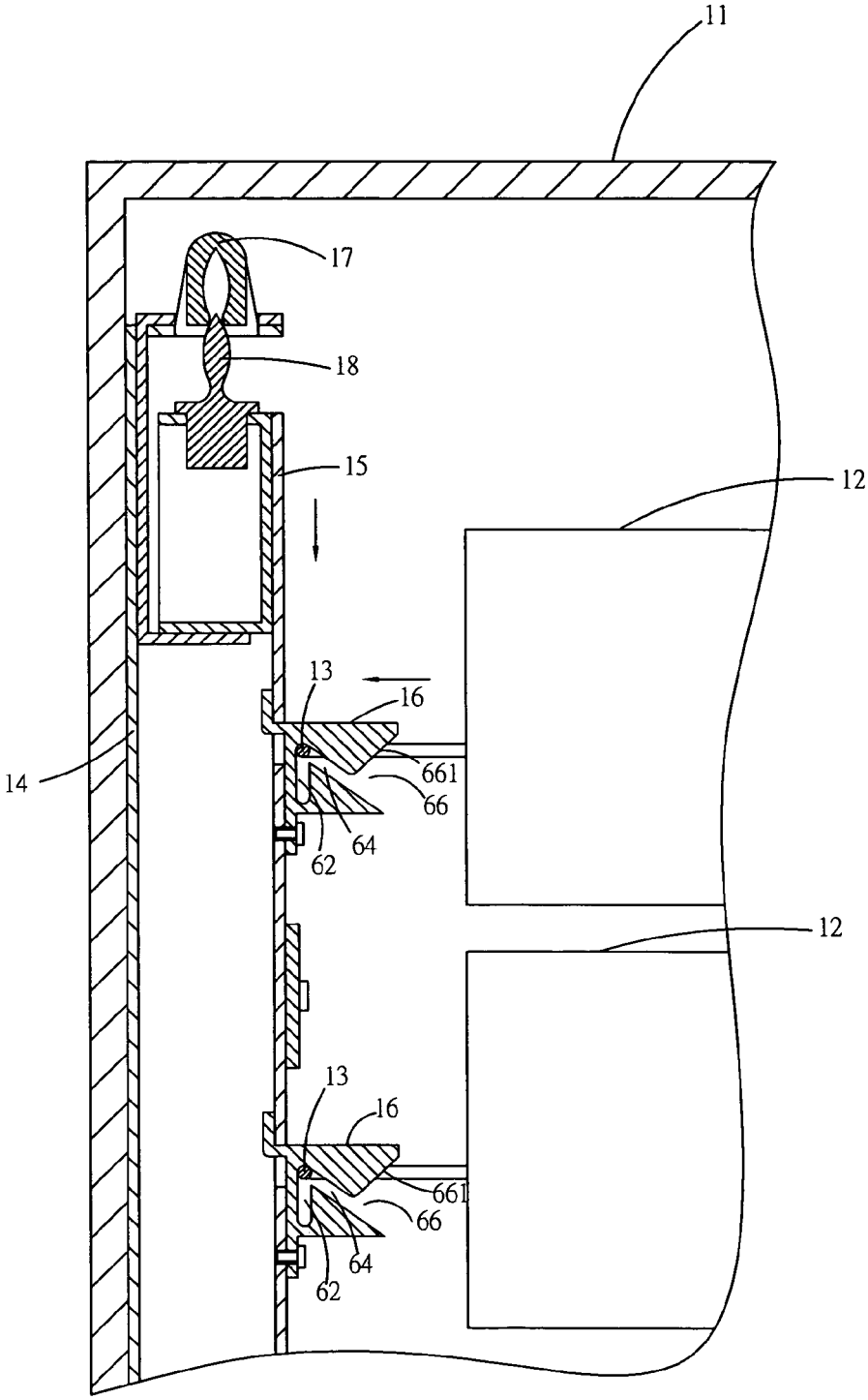
Figure 6:
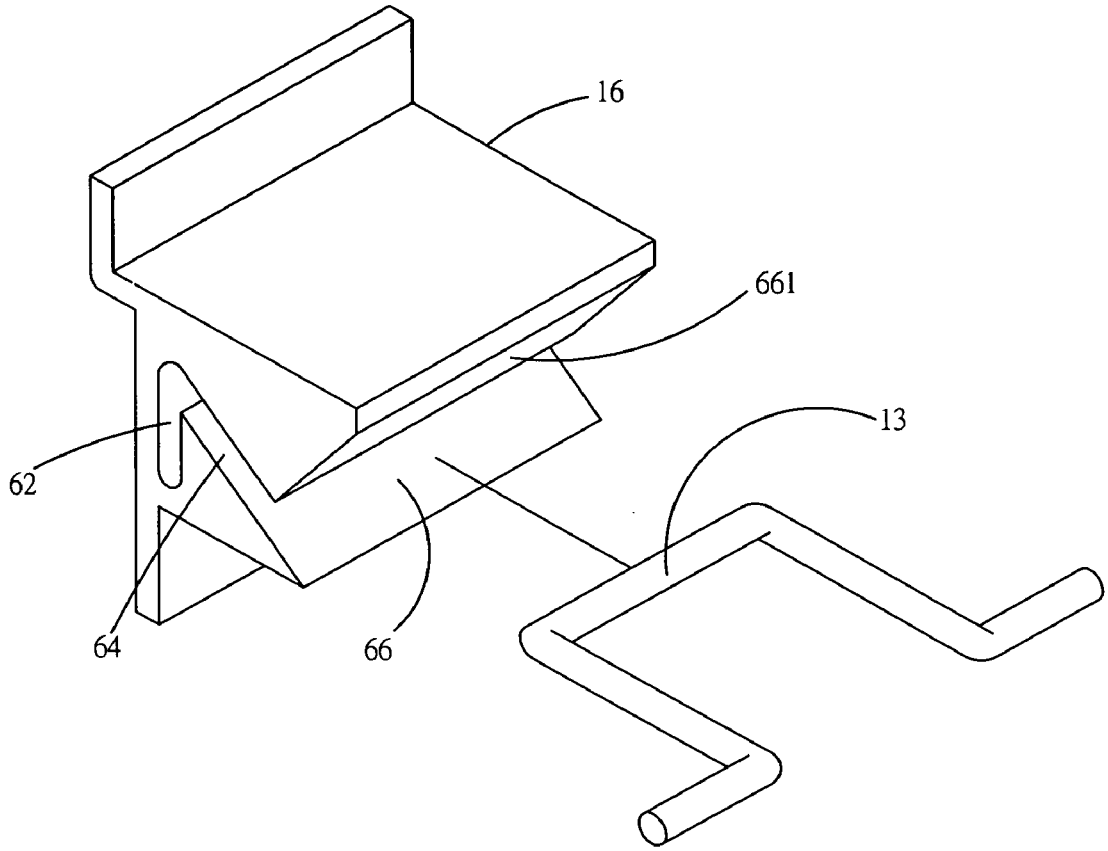
FIG. 6 is a perspective view of the activation section and the block body of the preferred embodiment of the present invention.

Please refer to FIGS. 1 to 6. The cabinet anti-tilt safety apparatus 1 of the present invention includes a cabinet body 11, at least two drawers 12, an activation section 13 disposed on each drawer, a base seat 14, a slide seat 15, a block body 16 disposed on the slide seat 15 corresponding to the activation section 13, a first connecting section 17 and a second connecting section 18.

The cabinet body 11 is a rectangular body composed of five rectangular panels which define an internal space and a vertical open face. The drawers 12 are vertically and back and forth slidably arranged in the open face. The activation section 13 is disposed on a predetermined section of rear side of the drawer 12.

The activation section 13 is a rod body leftward and rightward extending by a certain length.

The base seat 14 is fixed on inner face of a panel of the cabinet body 11 corresponding to the rear side of the drawers 12.

The slide seat 15 is slidably fitted with the base seat 14. The slide seat 15 is up and down reciprocally movable between a first position and a second position. The block body 16 is disposed on the slide seat 15 corresponding to the activation section 13.

The block body 16 has an inner slide way 62 and a middle slide way 64. The inner slide way 62 is an elongated slot vertically extending by a predetermined length. The middle slide way 64 is an elongated slot obliquely downward extending from upper end of the inner slide way 62 toward the activation section 13 by a predetermined length. The activation section 13 can be reciprocally moved to get into or out of the corresponding block body 16 so as to push inner edge of the middle slide way 64. Accordingly, the slide seat 15 can be reciprocally moved between the first and second positions.

The first connecting section 17 is disposed at one end of the base seat 14.

The second connecting section 18 is disposed at one end of the slide seat 15 corresponding to the first connecting section 17. After one drawer 12 is drawn out, the activation section 13 of the drawn out drawer 12 will drive the slide seat 15 to move upward. Then the first connecting section 17 will engage with the second connecting section 18, whereby the slide seat 15 is positioned in the first position and the activation sections 13 of the remaining drawers 12 will engage with lower ends of the corresponding inner slide ways 62.

After the drawn out drawer 12 is pushed back into the cabinet body 11, the activation section 13 of the pushed back drawer 12 will drive the slide seat 15 to move downward. Then the first connecting section 17 will disengage from the second connecting section 18, whereby the slide seat 15 is positioned in the second position and the activation sections 13 of all the drawers 12 will disengage from the corresponding inner slide ways 62.

According to the above arrangement, only one drawer can be drawn out at one time, while the other drawers are locked. Therefore, the present invention can achieve an anti-tilt safety function.

The cabinet anti-tilt safety apparatus 1 of the present invention has the following advantages:

1. It is unnecessary to mount the structure of the present invention between the drawer slide rail assemblies. Therefore, the difficulty in installation is avoided.
2. The present invention has simple components and can be easily assembled.

The block body 16 further includes an outer slide way 66. A lower edge of the outer slide way 66 further extends from the lower edge of the middle slide way 64. An upper edge of the outer slide way 66 further obliquely upward extends from the upper edge of the middle slide way 64 to form a restoring slope 661. In the case that after one drawer 12 is drawn out, an unexpected external force is applied to the cabinet body 11 to make the slide seat 15 fall into the second position, when the drawn out drawer 12 is again pushed in, the activation section 13 of the drawn out drawer 12 will push the corresponding restoring slope 661 to move the slide seat 15 upward. At this time, the first and second connecting sections 17, 18 will engage with each other and the slide seat 15 is positioned in the first position. Accordingly, the restoring slope 661 provides a security effect for restoring the function of the present invention.

The first connecting section 17 is a resilient clip body having an internal cavity and a lower opening.

The second connecting section 18 is a rod body positioned under the first connecting section 17. The rod body has an elliptic cross-section. The internal cavity of the clip body has a shape corresponding to the profile of the rod body.

The above embodiments are only used to illustrate the present invention, not intended to limit the scope thereof. Many modifications of the above embodiments can be made without departing from the spirit of the present invention.

What is claimed is:

1. A cabinet anti-tilt safety apparatus comprising:

a cabinet body which is a rectangular body composed of five rectangular panels which define an internal space and a vertical open face, at least two drawers being back and forth slidably arranged in the open face;

an activation section which is a rod body leftward and rightward extending by a certain length, the activation section being disposed on a predetermined section of rear side of each drawer;

a base seat fixed on inner face of a panel of the cabinet body corresponding to the rear side of each drawer;

a slide seat slidably fitted with the base seat, the slide seat being up and down reciprocally movable between a first position and a second position, a block body being disposed on the slide seat corresponding to the activation section, the block body having an inner slide way and a middle slide way, the inner slide way being an elongated slot vertically extending by a predetermined length, the middle slide way being an elongated slot obliquely downward extending from upper end of the inner slide way toward the activation section by a predetermined length, the activation section being reciprocally movable to get into or out of the corresponding block body so as to push inner edge of the middle slide way, whereby the slide seat can be reciprocally moved between the first and second positions;

a first connecting section disposed at one end of the base seat;

a second connecting section disposed at one end of the slide seat corresponding to the first connecting section, after one drawer is drawn out, the activation section of the drawn out drawer driving the slide seat and then the first connecting section being engaged with the second connecting section, whereby the slide seat is positioned in the first position and the activation sections of the remaining drawers are engaged with lower ends of the corresponding inner slide ways, after the drawn out drawer is pushed back into the cabinet body, the activation section of the pushed back drawer driving the slide seat and then the first connecting section being disengaged from the second connecting section, whereby the slide seat is positioned in the second position and the activation sections of all the drawers are disengage from the corresponding inner slide ways.

2. The cabinet anti-tilt safety apparatus as claimed in claim 1, wherein the block body further includes an outer slide way, a lower edge of the outer slide way further extending from lower edge of the middle slide way, an upper edge of the outer slide way further obliquely upward extending from upper edge of the middle slide way to form a restoring slope, in the case that after one drawer is drawn out, an unexpected external force is applied to the cabinet body to make the slide seat move to the second position, when the drawn out drawer is again pushed in, the activation section of the drawn out drawer will push the corresponding restoring slope to move the slide seat, whereby the first and second connecting sections are engaged with each other and the slide seat is positioned in the first position.

3. The cabinet anti-tilt safety apparatus as claimed in claim 1, wherein the first connecting section is a resilient clip body having an internal cavity and an opening and the second connecting section is a rod body.

4. The cabinet anti-tilt safety apparatus as claimed in claim 2, wherein the first connecting section is a resilient clip body having an internal cavity and an opening and the second connecting section is a projecting body.

5. The cabinet anti-tilt safety apparatus as claimed in claim 3, wherein the rod body has an elliptic cross-section and the internal cavity of the clip body has a shape corresponding to the profile of the rod body.

6. The cabinet anti-tilt safety apparatus as claimed in claim 4, wherein the projecting body has an elliptic cross-section and the internal cavity of the clip body has a shape corresponding to the profile of the projecting body.

* * * * *